US009850447B2

(12) United States Patent
Greaves et al.

(10) Patent No.: US 9,850,447 B2
(45) Date of Patent: Dec. 26, 2017

(54) POLYALKYLENE GLYCOLS USEFUL AS LUBRICANT ADDITIVES FOR HYDROCARBON BASE OILS

(71) Applicant: Dow Global Technologies LLC, Midland, MI (US)

(72) Inventors: Martin R. Greaves, Baar (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 15 days.

(21) Appl. No.: 14/772,079

(22) PCT Filed: May 13, 2014

(86) PCT No.: PCT/US2014/037798

§ 371 (c)(1),
(2) Date: Sep. 2, 2015

(87) PCT Pub. No.: WO2014/189711

PCT Pub. Date: Nov. 27, 2014

(65) Prior Publication Data

US 2016/0060561 A1 Mar. 3, 2016

Related U.S. Application Data

(60) Provisional application No. 61/826,538, filed on May 23, 2013.

(51) Int. Cl.

*C10M 145/30* (2006.01)
*C10M 169/04* (2006.01)
*C10M 111/04* (2006.01)

(52) U.S. Cl.

CPC ..... *C10M 145/30* (2013.01); *C10M 111/04* (2013.01); *C10M 169/041* (2013.01); *C10M 2203/1006* (2013.01); *C10M 2203/1025* (2013.01); *C10M 2209/105* (2013.01); *C10M 2209/106* (2013.01); *C10M 2209/1055* (2013.01); *C10M 2209/1065* (2013.01); *C10N 2220/021* (2013.01); *C10N 2220/022* (2013.01); *C10N 2230/02* (2013.01); *C10N 2230/70* (2013.01); *C10N 2240/04* (2013.01); *C10N 2240/08* (2013.01); *C10N 2240/10* (2013.01); *C10N 2240/30* (2013.01)

(58) Field of Classification Search

CPC ..... C10M 145/30; C10M 145/32; C10M 111/04; C10M 169/041; C10N 2203/1006; C10N 2203/1025; C10N 2209/105; C10N 2209/1055; C10N 2209/106; C10N 2209/1065; C10N 2220/021; C10N 2220/022; C10N 2230/02; C10N 2230/70; C10N 2240/04; C10N 2240/08; C10N 2240/10; C10N 2240/30

USPC ..... 508/300

See application file for complete search history.

(56) References Cited

U.S. PATENT DOCUMENTS

| | | | | |
|---|---|---|---|---|
| 2,620,304 | A | 12/1952 | Stewart | |
| 3,789,003 | A | 1/1974 | McCoy | |
| 3,843,535 | A | 10/1974 | Denis et al. | |
| 4,259,405 | A | 3/1981 | Newkirk et al. | |
| 4,338,207 | A * | 7/1982 | Adams | C10M 141/08 252/401 |
| 4,481,123 | A | 11/1984 | Hentschel et al. | |
| 4,793,939 | A | 12/1988 | Mori et al. | |
| 5,053,154 | A | 10/1991 | Oppenlaender et al. | |
| 5,143,640 | A | 9/1992 | Moxey | |
| 5,145,948 | A | 9/1992 | Oppenlaender et al. | |
| 5,198,135 | A | 3/1993 | Galic et al. | |
| 5,494,595 | A | 2/1996 | Nieh | |
| 5,681,797 | A | 10/1997 | Lawate | |
| 5,741,946 | A | 4/1998 | Wei | |
| 6,087,307 | A | 7/2000 | Kaminski et al. | |
| 6,458,750 | B1 | 10/2002 | Dardin et al. | |
| 6,579,329 | B1 * | 6/2003 | Thomas | C10L 1/143 208/16 |
| 6,667,285 | B1 | 12/2003 | Kawahara et al. | |
| 2003/0236177 | A1 | 12/2003 | Wu et al. | |
| 2005/0256014 | A1 * | 11/2005 | Sherman | C08G 65/2609 508/579 |
| 2011/0098492 | A1 | 4/2011 | Varineau et al. | |
| 2012/0108482 | A1 * | 5/2012 | Greaves | C10M 107/34 508/579 |

FOREIGN PATENT DOCUMENTS

| | | |
|---|---|---|
| CA | 2034144 | 7/1991 |
| EP | 0524783 | 1/1993 |
| WO | 2004087789 | 10/2004 |
| WO | 2011011656 | 1/2011 |
| WO | 2012070007 | 3/2012 |

* cited by examiner

*Primary Examiner* — James Goloboy
(74) *Attorney, Agent, or Firm* — Brooks, Cameron & Huebsch, PLLC

(57) ABSTRACT

Provided are lubricant compositions comprising a base oil, a polyoxypropylene polymer, and a butyleneoxy based polyoxyalkylene polymer. The base oil, polyoxypropylene polymer and polyoxyalkylene polymer are soluble with one another.

14 Claims, No Drawings

POLYALKYLENE GLYCOLS USEFUL AS LUBRICANT ADDITIVES FOR HYDROCARBON BASE OILS

FIELD

This invention relates generally to a lubricant composition. More specifically, the invention relates to a lubricant composition containing a base oil and a polyoxypropylene polymer additive, wherein the polyoxypropylene polymer additive is solubilized in the base oil by the inclusion in the composition of a butyleneoxy based polyoxyalkylene polymer.

BACKGROUND

Lubricant compositions are widely used in devices with moving mechanical parts, in which their role is to reduce friction between the moving parts. This reduction may, in turn, reduce wear and tear and/or improve the device's overall performance. In many applications lubricant compositions also serve related and non-related supplemental purposes, such as reducing corrosion, cooling components, reducing fouling, controlling viscosity, demulsifying, and/or increasing pumpability.

Most lubricant compositions today include a base oil. Generally this base oil is a hydrocarbon oil or a combination of hydrocarbon oils. The hydrocarbon oils have been classified based on their composition and physical properties by the American Petroleum Institute as Group I, II, III or IV base oils. In order to further modify properties of the various base oils, so-called additive packages are frequently employed. Such may include materials designed to serve as antioxidants, corrosion inhibitors, antiwear additives, foam control agents, yellow metal passivators, dispersants, detergents, extreme pressure additives, friction reducing agents, and/or dyes. It is highly desirable that all additives be soluble in the base oil. Such solubility is preferably maintained across a wide range of temperature and other conditions in order to enable shipping, storage, and/or prolonged use of these compositions.

One class of additives that is of interest to lubricant formulators are polyalkylene glycols, or "PAGs." Many PAGs are based on ethylene oxide or propylene oxide homopolymers, and are in some cases ethylene oxide/propylene oxide co-polymers. They often offer good performance and environmental properties, including good hydrolytic stability, low toxicity and biodegradability, desirable low temperature properties, and good film-forming properties.

Unfortunately, traditional PAGs, such as co-polymers of ethylene oxide (EO) and propylene oxide (PO) and homopolymers of propylene oxide are often not soluble at treat levels of greater than 5 percent in the classical base oils. This led to the development of oil soluble polyalkylene glycols (OSP) which can be used as performance enhancing additives in hydrocarbon lubricants (see for example WO2011/011656). Two series of OSP products are commercially available. One series is based on co-polymers of PO and BO (butylene oxide) and a second series is based on homopolymers of BO (polybutylene glycols). These offer excellent solubility in most Group I-IV base oils. A downside to these OSPs, however, is cost. In particular, BO containing OSPs are more expensive because butylene oxide, one of the starting materials for making the polymers, has high cost.

Therefore if a formulator would like to minimize his/her cost to manufacture of a hydrocarbon oil that contains a PAG then it would be more advantageous to use a PAG that comprises an OSP with a PO homo-polymer, a less expensive material, than one that contains an OSP alone.

The problem addressed by this invention is the provision of PAG compositions that contain cost effective PO homopolymers and that nevertheless provide improved properties, such as solubility, in hydrocarbon base oils.

STATEMENT OF INVENTION

We have now found that polyoxypropylene (PO) homopolymers may be formulated into hydrocarbon base oils by coupling them with a butyleneoxy based polyoxyalkylene polymer. Advantageously, even though the PO homopolymers are generally not soluble in the base oil, that insolubility may be overcome by the presence of the BO based polyoxyalkylene polymer.

In addition to reduced costs, a further benefit of incorporating a PO homo-polymer into a base oil is that it can boost viscosity index more than using simply an OSP when the total PAG treat level is the same.

In one aspect, therefore, there is provided a lubricant composition comprising: a hydrocarbon base oil; a polyoxypropylene polymer prepared by polymerizing propylene oxide with an initiator containing a labile hydrogen; and a polyoxyalkylene polymer prepared by polymerizing an alkylene oxide feed with an initiator containing a labile hydrogen, the alkylene oxide feed comprising from 100 to 25 percent butylene oxide and from 0 to 75 percent propylene oxide, each by weight based on the total weight of the alkylene oxide feed, provided that when the alkylene oxide feed contains greater than 50 percent by weight propylene oxide, the initiator is a C8-C20 alkyl alcohol.

In another aspect, there is provided a method of lubricating a mechanical device, the method comprising using a lubricant composition as described herein to lubricate the mechanical device.

DETAILED DESCRIPTION

Unless otherwise indicated, numeric ranges, for instance as in "from 2 to 10," are inclusive of the numbers defining the range (e.g., 2 and 10).

Unless otherwise indicated, ratios, percentages, parts, and the like are by weight. Unless otherwise indicated, the phrase "molecular weight" refers to the number average molecular weight as measured in a conventional manner.

"Ethyleneoxy" or "EO" as used in this specification refers to $—CH_2—CH_2—O—$, "propyleneoxy" or "PO" refers to $—CH_2—CH(CH_3)—O—$ or $—CH(CH_3)—CH_2—O—$, and "butyleneoxy" or "BO" refers to $—CH_2—CH(CH_2CH_3)—O—$ or $—CH(CH_2CH_3)—CH_2—O—$. "Alkyl" encompasses straight and branched chain aliphatic groups having the indicated number of carbon atoms.

The invention provides a lubricant composition comprising a hydrocarbon base oil, a polyoxypropylene polymer, and a polyoxyalkylene polymer, and methods for its use. Advantageously, the base oil, polyoxypropylene polymer, and polyoxyalkylene polymer of the composition are soluble in each other.

Hydrocarbon base oils useful in the composition of the invention include the hydrocarbon base oils designated by the American Petroleum Institute as falling into Group I, II, III or IV. Of these, the Group I, II, and III oils are natural mineral oils. Group I oils are composed of fractionally distilled petroleum which is further refined with solvent extraction processes to improve properties such as oxidation resistance and to remove wax. Group II oils are composed of fractionally distilled petroleum that has been hydrocracked to further refine and purify it. Group III oils have similar characteristics to Group II oils, with Groups II and III both being highly hydro-processed oils which have undergone various steps to improve their physical properties. Group III oils have higher viscosity indexes than Group II oils, and are prepared by either further hydrocracking of Group II oils, or by hydrocracking of hydroisomerized slack wax, which is a byproduct of the dewaxing process used for many of the oils in general. Group IV oils are synthetic hydrocarbon oils, which are also referred to as polyalphaolefins (PAOs). Mixtures of the foregoing oils may be used. Lubricant compositions of the invention preferably contain up to 50 percent of the hydrocarbon base oil by weight based on the total weight of the hydrocarbon base oil, the polyoxypropylene polymer, and the polyoxyalkylene polymer. In some embodiments, the lubricant compositions contain at least 40 weight percent, alternatively at least 30 weight percent, alternatively at least 20 weight percent, or alternatively at least 10 weight percent of the hydrocarbon base oil.

The polyoxypropylene polymer useful herein (also referred to as a PO homopolymer) may be prepared by polymerizing propylene oxide with an initiator containing a labile hydrogen. Such polymerization processes are known to those skilled in the art (see for instance United States Patent publication number 2011/0098492, which is incorporated herein by reference) and suitable polymers are commercially available. In a typical polymerization procedure, an initiator is alkoxylated with an alkylene oxide compound in the presence of acidic or alkaline catalysts, or by using metal cyanide catalysts. In the case of the polyoxypropylene polymer, the alkylene oxide compound is propylene oxide. Alkaline polymerization catalysts may include, for instance, hydroxides or alcoholates of sodium or potassium, including NaOH, KOH, sodium methoxide, potassium methoxide, sodium ethoxide and potassium ethoxide. Base catalysts are typically used in a concentration of from 0.05 percent to about 5 percent by weight, preferably about 0.1 percent to about 1 percent by weight based on starting material.

The addition of alkylene oxide may, for instance, be carried out in an autoclave under pressures from about 10 psig to about 200 psig, preferably from about 60 to about 100 psig. The temperature of alkoxylation may range from about 30° C. to about 200° C., preferably from about 100° C. to about 160° C. After completion of oxide feeds, the product is typically allowed to react until the residual oxide is reduced to a desired level, for instance less than about 10 ppm. After cooling the reactor to an appropriate temperature ranging for instance from about 20° C. to 130° C., the residual catalyst may be left unneutralized, or neutralized with organic acids, such as acetic, propionic, or citric acid. Alternatively, the product may be neutralized with inorganic acids, such as phosphoric acid or carbon dioxide. Residual catalyst may also be removed using, for example, ion exchange or an adsorption media, such as diatomaceous earth.

Initiators containing labile hydrogens suitable for use in the polymerization include, for instance, amine compounds, thiol compounds, monols, diols, and triols. Preferred are diol and monol compounds. Examples of suitable diol compounds include, without limitation, ethyleneglycol, 1,2-propyleneglycol, 1,3-propylene glycol, 1,4-butanediol, 1,6-hexanediol 1,2-hexanediol, diethyleneglycol, triethyleneglycol, dipropyleneglycol and tripropyleneglycol.

Monol initiators for use in the invention include, for instance, aliphatic alkyl alcohols containing one hydroxyl (OH) group and optionally one or more ether linkages (e.g., glycol ethers such as mono or polyoxyalkylene monoethers). Such compounds are collectively referred to herein as alkyl alcohols. In some embodiments, the alkyl alcohol preferably has from 4 carbon atoms to 22 carbon atoms per molecule. Specific examples include, but are not limited to, butanol, pentanol, hexanol, neopentanol, isobutanol, heptanol, octanol, 2-ethylhexanol, nonanol, decanol, propylene glycol n-butyl ether (available from The Dow Chemical Company as DOWANOL™ PnB), dipropylene glycol n-butyl ether (available from Dow as DOWANOL™ DPnB), and dodecyl alcohol (available e.g., as NACOL® 12-99 from Sasol). Particularly preferred initiators are n-butanol and propylene glycol n-butyl ether.

Sufficient propylene oxide is used in the polymerization with the initiator to provide a polyoxypropylene polymer having a desired number average molecular weight which, in some embodiments, is up to 2600 g/mol, alternatively up to 2300 g/mol, alternatively up to 1300 g/mol, or alternatively up to 700 g/mol. In some embodiments, the molecular weight is at least 400 g/mol. In some embodiments, the molecular weight is from 400 g/mol to 2600 g/mol.

In some embodiments, the polyoxypropylene polymer is included in the lubricant compositions of the invention at a concentration of up to 80 percent by weight, alternatively up to 60 percent by weight, alternatively up to 40 percent by weight, alternatively up to 30 percent by weight, alternatively up to 20 percent by weight, or alternatively up to 10 percent by weight, based on the total weight of the base oil, the polyoxypropylene polymer, and the polyoxyalkylene polymer. In some embodiments, the polyoxypropylene polymer is included at a concentration of at least 10 percent by weight.

The polyoxyalkylene polymer for use in the invention may be prepared by polymerizing an alkylene oxide feed with an initiator containing a labile hydrogen using analogous techniques to those described above (with appropriate substitution of alkylene oxide and initiator). The alkylene oxide feed for the polymerization comprises from 100 to 25 percent butylene oxide and from 0 to 75 percent propylene oxide, each by weight based on the total weight of the alkylene oxide feed. As with the polyoxypropylene polymer described above, the initiators containing labile hydrogens for the polymerization may, for instance, be an amine compound, a thiol compound, a monol, a diol, a triol, or water. Preferred are diol and monol compounds. Examples of suitable diol compounds include, without limitation, ethyleneglycol, 1,2-propyleneglycol, 1,2-hexanediol, diethyleneglycol, triethyleneglycol, dipropyleneglycol and tripropyleneglycol 1,3-propyleneglycol, 1,4-butanediol and 1,6-hexanediol. Preferred diol initiators are 1,2-propyleneglycol and dipropyleneglycol.

Monol initiators for use in the invention include alkyl alcohols analogous to those described above (including those optionally containing one or more ether linkages such as glycol ethers). Preferred alkyl alcohol compounds contain from 4 carbon atoms to 22 carbon atoms per molecule. Specific examples include, but are not limited to, butanol, pentanol, hexanol, neopentanol, isobutanol, heptanol, octanol, 2-ethylhexanol, nonanol, decanol, propylene glycol n-butyl ether (available from The Dow Chemical Company as DOWANOL™ PnB), dipropylene glycol n-butyl ether (available from Dow as DOWANOL™ DPnB), and dodecyl alcohol (available e.g., as NACOL® 12-99 from Sasol). Particularly preferred initiators are n-butanol and propylene glycol n-butyl ether.

Sufficient alkylene oxide is used in the polymerization with the initiator to provide a polyoxyalkylene polymer having a desired number average molecular weight which, in some embodiments, is up to 5000 g/mol, alternatively up to 3000 g/mol, alternatively up to 2400 g/mol, alternatively up to 1200 g/mol, or alternatively up to 760 g/mol. In some embodiments, the polyoxyalkylene polymer has a number average molecular weight of at least 500 g/mol.

Lubricant compositions of the invention preferably contain up to 50 percent of the polyoxyalkylene polymer by weight, alternatively up to 40 percent by weight, alternatively up to 30 percent by weight, alternatively up to 20 percent by weight, or alternatively up to 10 percent by weight, based on the total weight of the base oil, the polyoxypropylene polymer, and the polyoxyalkylene polymer. In some embodiments, the lubricant compositions contain at least 10 weight percent of the polyoxyalkylene polymer.

In some embodiments of the invention, the alkylene oxide feed used for preparing the polyoxyalkylene polymer is butylene oxide and thus the resultant polymer is a butyleneoxy homopolymer (also referred to herein as a BO homopolymer). Preferred initiators for this embodiment include 1,2-propyleneglycol and dipropyleneglycol, or a $C_4$-$C_{22}$ alkyl alcohol such as butanol or propylene glycol n-butyl ether.

In some embodiments of the invention, the alkylene oxide feed used for preparing the polyoxyalkylene polymer contains both butylene oxide and propylene oxide. The resultant polyoxyalkylene polymer is a copolymer containing propyleneoxy and butyleneoxy groups (also referred to herein as a BO/PO copolymer). In some embodiments, the alkylene oxide feed contains from 67 to 33 percent by weight of butylene oxide and from 33 to 67 percent by weight of propylene oxide. In some embodiments, the alkylene oxide feed contains about 50 percent butylene oxide and about 50 percent propylene oxide.

In some embodiments, the alkylene oxide feed contains from 67 to 33 percent by weight of butylene oxide and from 33 to 67 percent by weight of propylene oxide and the initiator is a $C_4$-$C_{22}$ alkyl alcohol, alternatively a $C_8$-$C_{20}$ alkyl alcohol, or alternatively a $C_8$-$C_{12}$ alkyl alcohol.

The components of the alkylene oxide feed may be polymerized with the initiator separately or together. The resultant copolymer, therefore, may be a block copolymer or a random copolymer, or a combination of random and block. For example if propylene oxide and butylene oxide are used to make a block copolymer, the propylene oxide can be added first to the initiator to produce a propyleneoxy block and then butylene oxide is added thereafter to produce a butyleneoxy block. Alternatively butylene oxide can be added first to the initiator to produce a butyleneoxy block and then propylene oxide is added thereafter to produce a propyleneoxy block. Or, for further example, the propylene oxide and butylene oxide may be added to the initiator as a mixture, thereby resulting in a random copolymer. Techniques for preparing copolymers in random, block or combination configurations are well known in the art. Random copolymers are preferred.

It should be noted that as the amount of propyleneoxy in the alkylene oxide feed used for making the copolymer increases to greater than 50 weight percent, the oil solubility of the copolymer decreases. This decrease in solubility, however, can be mitigated by using a $C_8$-$C_{20}$ alkyl alcohol, preferably a $C_8$-$C_{12}$ alkyl alcohol, as the initiator for the polymerization.

In some embodiments of the invention, the lubricant composition comprises up to 50 weight percent of a Group I base oil and up to 40 weight percent of the polyoxypropylene polymer (based on the total weight of the base oil, the polyoxypropylene polymer, and the polyoxyalkylene polymer), wherein the polyoxypropylene polymer has a molecular weight of up to 1300 g/mole and the polyoxyalkylene polymer is a PO/BO copolymer with a molecular weight up to 2400 g/mole.

In some embodiments of the invention, the lubricant composition comprises up to 50 weight percent of a Group I base oil and up to 25 weight percent of the polyoxypropylene polymer (based on the total weight of the base oil, the polyoxypropylene polymer, and the polyoxyalkylene polymer), wherein the polyoxypropylene polymer has a molecular weight of up to 2600 g/mole and the polyoxyalkylene polymer is a PO/BO copolymer with a molecular weight up to 1400 g/mole.

In some embodiments of the invention, the lubricant composition comprises up to 50 weight percent of a Group I base oil and up to 10 weight percent of the polyoxypropylene polymer (based on the total weight of the base oil, the polyoxypropylene polymer, and the polyoxyalkylene polymer), wherein the polyoxypropylene polymer has a molecular weight of up to 2600 g/mole and the polyoxyalkylene polymer is a PO/BO copolymer with a molecular weight up to 2400 g/mole.

In some embodiments of the invention, the lubricant composition comprises up to 50 weight percent of a Group III base oil and up to 30 weight percent of the polyoxypropylene polymer (based on the total weight of the base oil, the polyoxypropylene polymer, and the polyoxyalkylene polymer), and wherein the polyoxypropylene polymer has a molecular weight of up to 700 g/mole and the polyoxyalkylene polymer is a PO/BO copolymer with a molecular weight up to 760 g/mole.

In some embodiments of the invention, the lubricant composition comprises up to 50 weight percent of a Group III base oil and up to 10 weight percent of the polyoxypropylene polymer (based on the total weight of the base oil, the polyoxypropylene polymer, and the polyoxyalkylene polymer), and wherein the polyoxypropylene polymer has a molecular weight of up to 1300 g/mole and the polyoxyalkylene polymer is a PO/BO copolymer with a molecular weight up to 1400 g/mole.

In some embodiments of the invention, the lubricant composition comprises up to 50 weight percent of a Group IV base oil having a kinematic viscosity at 100° C. of 8 $mm^2/s$ or less and up to 30 weight percent of the polyoxypropylene polymer (based on the total weight of the base oil, the polyoxypropylene polymer, and the polyoxyalkylene polymer), and wherein the polyoxypropylene polymer has a molecular weight of up to 700 g/mole and the polyoxyalkylene polymer is a PO/BO copolymer with a molecular weight up to 760 g/mole.

In some embodiments of the invention, the lubricant composition comprises up to 50 weight percent of a Group IV base oil having a kinematic viscosity at 100° C. of 8 $mm^2/s$ or less and up to 10 weight percent of the polyoxypropylene polymer (based on the total weight of the base oil, the polyoxypropylene polymer, and the polyoxyalkylene polymer), and wherein the polyoxypropylene polymer has a molecular weight of up to 1300 g/mole and the polyoxyalkylene polymer is a PO/BO copolymer with a molecular weight up to 1400 g/mole.

In some embodiments of the invention, the lubricant composition comprises up to 50 weight percent of a Group I, Group III, or Group IV base oil and up to 30 weight percent of the polyoxypropylene polymer (based on the total weight of the base oil, the polyoxypropylene polymer, and the polyoxyalkylene polymer), and wherein the polyoxypropylene polymer has a molecular weight of up to 700 g/mole and the polyoxyalkylene polymer is a PO/BO copolymer with a molecular weight up to 760 g/mole.

In some embodiments of the invention, the lubricant composition comprises up to 50 weight percent of a Group I or Group IV base oil and up to 25 weight percent, alternatively up to 10 weight percent, of the polyoxypropylene polymer (based on the total weight of the base oil, the polyoxypropylene polymer, and the polyoxyalkylene polymer). In this embodiment, the polyoxyalkylene polymer preferably is a diol initiated BO homopolymer or an alkyl alcohol initiated BO homopolymer.

The lubricant compositions of the invention permit the formulation of polyoxypropylene polymers into hydrocarbon base oils as stable/homogenous mixtures (i.e., the components are soluble in one another). This is achieved by including in the compositions a polyoxyalkylene polymer that is a BO homopolymer or a BO/PO polymer copolymer.

Compositions of the invention may contain other additives including, for instance, antioxidants, corrosion inhibitors, antiwear additives, foam control agents, yellow metal passivators, dispersants, detergents, extreme pressure additives, friction reducing agents, and/or dyes.

The compositions of the invention are useful as lubricants for a variety of mechanical devices including, for example, internal combustion engines such as automotive engines, gear boxes, hydraulic pumps, compressors and transmissions.

Some embodiments of the invention will now be described in detail in the following Examples.

EXAMPLES

The materials in the following Table are used in the example compositions.

| Component Name | Chemistry |
|---|---|
| PO-700 | Butanol initiated PO homopolymer with a typical kinematic viscosity at 40° C. of 32 $mm^2/s$ (cSt) and an average molecular weight = 700 g/mole. |
| PO-1300 | Butanol initiated PO homopolymer with a typical kinematic viscosity at 40° C. of 70 $mm^2/s$ (cSt) and an average molecular weight = 1300 g/mole |
| PO-2300 | Butanol initiated PO homopolymer with a typical kinematic viscosity at 40° C. of 170 $mm^2/s$ (cSt) and an average molecular weight = 2300 g/mole |
| PO-2600 | Butanol initiated PO homopolymer with a typical kinematic viscosity at 40° C. of 220 mm /s (cSt) and an average molecular weight = 2600 g/mole |
| EO/PO-1300 | Butanol initiated EO/PO copolymer with a typical kinematic viscosity at 40° C. of 70 $mm^2/s$ (cSt) and an average molecular weight = 1300 g/mole |
| PO-400 | A polypropylene glycol with a typical kinematic viscosity at 40° C. of 32 $mm^2/s$ (cSt) and an average molecular weight = 400 g/mole |
| PO/BO-760 | Dodecanol initiated random copolymer (PO/BO, 50/50 by wt) with a typical kinematic viscosity at 40° C. of 32 $mm^2/s$ (cSt). Its average molecular weight is 760 g/mole |

-continued

| Component Name | Chemistry |
|---|---|
| PO/BO-1400 | Dodecanol initiated random copolymer (PO/BO, 50/50 by wt) with a typical kinematic viscosity at 40° C. of 68 $mm^2/s$ (cSt). Its average molecular weight is 1400 g/mole |
| PO/BO-2400 | Dodecanol initiated random copolymer (PO/BO, 50/50 by wt) with a typical kinematic viscosity at 40° C. of 220 $mm^2/s$ (cSt). Its average molecular weight is 2400 g/mole |
| BO-1 | 1,2-Propylene glycol initiated BO homopolymer with a typical kinematic viscosity at 40° C. of 320 $mm^2/s$ (cSt). Average molecular weight is 2600 g/mole |
| BO-2 | 1,2-Propylene glycol initiated BO homopolymer with a typical kinematic viscosity at 40° C. of 80 $mm^2/s$ (cSt). Average molecular weight is 1000 g/mole |
| BO-3 | Propylene glycol n-butyl ether (butanol plus PO) initiated BO homo-polymer with a typical kinematic viscosity at 40° C. of 60 $mm^2/s$ (cSt). Note the alcohol used is Dowanol PnB (i.e. butanol + 1 mole of PO), but this is still considered homo-polymer. Average molecular weight is 1000 g/mole |
| BO-4 | Propylene glycol n-butyl ether initiated BO homo-polymer with a typical kinematic viscosity at 40° C. of 185 $mm^2/s$ (cSt). Note the alcohol used is Dowanol PnB (i.e. butanol + 1 mole of PO), but this is still considered homo-polymer. Average molecular weight is 2000 g/mole |
| Total 150 S.N. (available from Total) | An API Group I mineral oil with a typical viscosity at 40° C. of 150 SUS |
| Shell Catenex S 523 (from Shell) | An API Group I mineral oil with a typical viscosity at 40° C. of 150 SUS |
| Nexbase 3080 (from Neste) | An API Group III mineral oil with a typical viscosity at 40° C. of 46 $mm^2/s$ (cSt). |
| Synfluid PAO-6 (from Chevron Phillips Chemical) | An API Group IV polyalphaolefin base oil with a typical kinematic viscosity at 100° C. of 6 $mm^2/s$ (cSt). |
| Spectrasyn 8 (from Exxon Mobil Chemical) | An API Group IV polyalphaolefin base oil with a typical kinematic viscosity at 100° C. of 8 $mm^2/s$ (cSt). |
| Spectrasyn 40 (from Exxon Mobil Chemical) | An API Group IV polyalphaolefin base oil with a typical kinematic viscosity at 100° C. of 40 $mm^2/s$ (cSt). |
| Synfluid 4 (from Chevron Phillips Chemical) | An API Group IV polyalphaolefin base oil with a typical kinematic viscosity at 100° C. of 4 $mm^2/s$ (cSt). |

Blending Procedure

The tables below describe lubricant compositions that are examined for their stability.

To a 200 ml glass beaker is added each blend component such that the total weight of the mixture is 100 g. The mixture is stirred for 30 minutes at room temperature (22-24° C.). Each composition is transferred to a glass jar and sealed and stored at room temperature for 1 week. The blends are visually inspected and rated as "clear," "turbid," or as "2 or 3 layers." The compositions that are described as "clear" are homogeneous and considered to be stable. Stable/homogenous compositions are desired for most lubricant applications.

In the Tables, blends that represent the invention are labeled as "Inv. Ex." Comparative Examples are labeled as "C. Ex."

TABLE 1

Compositions of a Group I mineral oil with PO/BO-760

| | C. Ex % | C. Ex % | C. Ex % | C. Ex % | Inv. Ex % | Inv. Ex % | Inv. Ex % | Inv. Ex % | C. Ex % | Inv. Ex % |
|---|---|---|---|---|---|---|---|---|---|---|
| Total 150 SN | 50 | 90 | 10 | 50 | 50 | 50 | 50 | 50 | 25 | 25 |
| PO-700 | 50 | 10 | 90 | | 10 | 25 | 30 | 40 | 75 | 50 |
| PO/BO-760 | | | | 50 | 40 | 25 | 20 | 10 | | 25 |
| appearance | 2 layers | 2 layers | clear | clear | clear | clear | clear | clear | clear | clear |
| Total 150 SN | 50 | 90 | 10 | 50 | 50 | 50 | 50 | 50 | 25 | 25 |
| PO-1300 | 50 | 10 | 90 | | 10 | 25 | 30 | 40 | 75 | 50 |
| PO/BO-760 | | | | 50 | 40 | 25 | 20 | 10 | | 25 |
| appearance | 2 layers | turbid | clear | clear | clear | clear | clear | clear | clear | clear |
| | C. Ex % | C. Ex % | C. Ex % | C. Ex % | Inv. Ex % | Inv. Ex % | Inv. Ex % | C. Ex % | C. Ex % | Inv. Ex % |
| Total 150 SN | 50 | 90 | 10 | 50 | 50 | 50 | 50 | 50 | 25 | 25 |
| PO-2600 | 50 | 10 | 90 | | 10 | 25 | 30 | 40 | 75 | 50 |
| PO/BO-760 | | | | 50 | 40 | 25 | 20 | 10 | | 25 |
| appearance | 2 layers | 2 layers | clear | clear | clear | clear | clear | 2 layers | 2 layers | clear |

Summary of Table 1. When the treat level of mineral oil is 50% it is possible to couple 40% of a PO homo-polymer using PO/BO-760 as the coupling agent. As the molecular weight of the PO homo-polymer increases the amount that can be coupled decreases. It is possible to couple 30% of PO homo-polymer when the polymers has a molecular weight of up to 2600 g/mole (PO-2600) and 40% when the PO homo-polymer has a molecular weight up to 1300 g/mole (PO-700 and PO-1300).

TABLE 2

Compositions of a Group I mineral oils with PO/BO-1400

| | C. Ex % | C. Ex % | C. Ex % | C. Ex % | Inv. Ex % | Inv. Ex % | Inv. Ex % | Inv. Ex % | C. Ex % | Inv. Ex % |
|---|---|---|---|---|---|---|---|---|---|---|
| Total 150 SN | 50 | 90 | 10 | 50 | 50 | 50 | 50 | 50 | 25 | 25 |
| PO-700 | 50 | 10 | 90 | | 10 | 25 | 30 | 40 | 75 | 50 |
| PO/BO-1400 | | | | 50 | 40 | 25 | 20 | 10 | | 25 |
| appearance | 2 layers | 2 layers | clear | clear | clear | clear | clear | clear | clear | clear |
| Total 150 SN | 50 | 90 | 10 | 50 | 50 | 50 | 50 | 50 | 25 | 25 |
| PO-1300 | 50 | 10 | 90 | | 10 | 25 | 30 | 40 | 75 | 50 |
| PO/BO-1400 | | | | 50 | 40 | 25 | 20 | 10 | | 25 |
| appearance | 2 layers | turbid | clear | clear | clear | clear | clear | clear | clear | clear |
| | C. Ex % | C. Ex % | C. Ex % | C. Ex % | Inv. Ex % | Inv. Ex % | C. Ex % | C. Ex % | C. Ex % | Inv. Ex % |
| Total 150 SN | 50 | 90 | 10 | 50 | 50 | 50 | 50 | 50 | 25 | 25 |
| PO-2600 | 50 | 10 | 90 | | 10 | 25 | 30 | 40 | 75 | 50 |
| PO/BO-1400 | | | | 50 | 40 | 25 | 20 | 10 | | 25 |
| appearance | 2 layers | 2 layers | clear | clear | clear | clear | 2 layers | 2 layers | 2 layers | clear |

Summary of Table 2. When the treat level of mineral oil is 50% it is possible to couple 40% of a PO homo-polymer using PO/BO-1400 as the coupling agent. As the molecular weight of the PO homo-polymer increases the amount that can be coupled decreases. It is possible to couple 25% of PO homo-polymer when its molecular weight is up to 2600 g/mole (PO-2600) but 40% when the PO homo-polymer has a molecular weight up to 1300 g/mole (PO-700 and PO-1300).

TABLE 3

Compositions of a Group I mineral oils with PO/BO-2400

| | C. Ex % | C. Ex % | C. Ex % | C. Ex % | Inv. Ex % | Inv. Ex % | Inv. Ex % | Inv. Ex % | C. Ex % | Inv. Ex % |
|---|---|---|---|---|---|---|---|---|---|---|
| Total 150 SN | 50 | 90 | 10 | 50 | 50 | 50 | 50 | 50 | 25 | 25 |
| PO-700 | 50 | 10 | 90 | | 10 | 25 | 30 | 40 | 75 | 50 |
| PO/BO-2400 | | | | 50 | 40 | 25 | 20 | 10 | | 25 |
| appearance | 2 layers | 2 layers | clear | clear | clear | clear | clear | clear | clear | clear |
| Total 150 SN | 50 | 90 | 10 | 50 | 50 | 50 | 50 | 50 | 25 | 25 |
| PO-1300 | 50 | 10 | 90 | | 10 | 25 | 30 | 40 | 75 | 50 |
| PO/BO-2400 | | | | 50 | 40 | 25 | 20 | 10 | | 25 |
| appearance | clear 2 layers | turbid | clear | clear | clear | clear | clear | clear | clear | clear |
| | C. Ex % | C. Ex % | C. Ex % | C. Ex % | Inv. Ex % | C. Ex % | C. Ex % | C. Ex % | C. Ex % | Inv. Ex % |
| Total 150 SN | 50 | 90 | 10 | 50 | 50 | 50 | 50 | 50 | 25 | 25 |
| PO-2600 | 50 | 10 | 90 | | 10 | 25 | 30 | 40 | 75 | 50 |
| PO/BO-2400 | | | | 50 | 40 | 25 | 20 | 10 | | 25 |
| appearance | 2 layers | 2 layers | clear | clear | clear | 2 layers | 2 layers | 2 layers | 2 layers | clear |

Summary of Table 3. When the treat level of mineral oil is 50% it is possible to couple 40% of a PO homo-polymer using PO/BO-2400 as the coupling agent. As the molecular weight of the PO homo-polymer increases the amount that can be coupled decreases. It is possible to couple 10% of PO homo-polymer when its molecular weight is 2600 g/mole (PO-2600) and up to 40% when the PO homo-polymer has a molecular weight up to 1300 g/mole (PO-700 and PO-1300).

TABLE 4

Compositions of a Group III mineral oil with PO/BO-760

| | C.Ex % | C.Ex % | Inv.Ex % | Inv.Ex % | Inv.Ex % | C.Ex % | Inv.Ex % |
|---|---|---|---|---|---|---|---|
| Nexbase 3080 | 50 | 90 | 50 | 50 | 50 | 90 | 50 |
| PO/BO-760 | 50 | | 40 | 25 | 20 | | 40 |
| PO-700 | | 10 | 10 | 25 | 30 | | |
| PO-1300 | | | | | | 10 | 10 |
| PO-2300 | | | | | | | |
| Appearance | clear | turbid | clear | clear | clear | turbid | clear |
| | C.Ex % | C.Ex % | C.Ex % | Inv.Ex % | C.Ex % | C.Ex % | |
| Nexbase 3080 | 50 | 50 | 90 | 50 | 50 | 50 | |
| PO/BO-760 | 25 | 20 | | 40 | 25 | 20 | |
| PO-700 | | | | | | | |
| PO-1300 | 25 | 30 | | | | | |
| PO-2300 | | | 10 | 10 | 25 | 30 | |
| Appearance | 3 phase | 3 phase | turbid | clear | 2 phase | 3 phase | |

Summary of Table 4. When the treat level of Group III oil (Nexbase 3080) is 50% it is possible to couple 30% of a PO homo-polymer using PO/BO-760 as the coupling agent. As the molecular weight of the PO homo-polymer increases the amount that can be coupled decreases. It is possible to couple 10% of PO homo-polymer when its molecular weight is up to 2300 g/mole (PO-1300 and PO-2300).

TABLE 5

Compositions of a Group III mineral oil with PO/BO-1400

| | C.Ex % | C.Ex % | Inv. Ex % | C.Ex % | C.Ex % | C.Ex % | Inv. Ex % |
|---|---|---|---|---|---|---|---|
| Nexbase 3080 | 50 | 90 | 50 | 50 | 50 | 90 | 50 |
| PO/BO-1400 | 50 | | 40 | 25 | 20 | | 40 |
| PO-700 | | 10 | 10 | 25 | 30 | | |
| PO-1300 | | | | | | 10 | 10 |
| PO-2300 | | | | | | | |
| appearance | clear | turbid | clear | 2-phases | 3-phases | turbid | clear |
| | C.Ex % | C.Ex % | C.Ex % | C.Ex % | C.Ex % | C.Ex % | |
| Nexbase 3080 | 50 | 50 | 90 | 50 | 50 | 50 | |
| PO/BO-1400 | 25 | 20 | | 40 | 25 | 20 | |
| PO-700 | | | | | | | |
| PO-1300 | 25 | 30 | | | | | |
| PO-2300 | | | 10 | 10 | 25 | 30 | |
| appearance | 3-phases | 2-phases | turbid | 2-phases | 2-phases | 3-phases | |

Summary of Table 5. When the treat level of Group III oil (Nexbase 3080) is 50% it is possible to couple 10% of a PO homo-polymer using PO/BO-1400 as the coupling agent.

TABLE 6

Compositions of a Group III mineral oil with PO/BO-2400

| | C.Ex % | C.Ex % | C.Ex % | C.Ex % | C.Ex % | C.Ex % | C.Ex % |
|---|---|---|---|---|---|---|---|
| Nexbase 3080 | 50 | 90 | 50 | 50 | 50 | 90 | 50 |
| PO/BO-2400 | 50 | | 40 | 25 | 20 | | 40 |
| PO-700 | | 10 | 10 | 25 | 30 | | |
| PO-1300 | | | | | | 10 | 10 |
| PO-2300 | | | | | | | |
| appearance | turbid | turbid | 3-phases | 3-phases | 3-phases | turbid | 3-phases |

TABLE 6-continued

| Compositions of a Group III mineral oil with PO/BO-2400 | | | | | | |
|---|---|---|---|---|---|---|
| | C.Ex % | C.Ex % | C.Ex % | C.Ex % | C.Ex % | C.Ex % |
| Nexbase 3080 | 50 | 50 | 90 | 50 | 50 | 50 |
| PO/BO-2400 | 25 | 20 | | 40 | 25 | 20 |
| PO-700 | | | | | | |
| PO-1300 | 25 | 30 | | | | |
| PO-2300 | | | 10 | 10 | 25 | 30 |
| appearance | 2-phases | 2-phases | turbid | 2-phases | 2-phases | 2-phases |

Summary of Table 6. PO homo-polymers did not readily solubilize with PO/BO-2400 at levels of 10% and higher.

TABLE 7

| Compositions of a Group IV PAO oil with PO/BO-760 | | | | | | | | | | |
|---|---|---|---|---|---|---|---|---|---|---|
| | C. Ex % | C. Ex % | C. Ex % | Inv. Ex % | Inv. Ex % | Inv. Ex % | C. Ex % | C. Ex % | C. Ex % | Inv. Ex % |
| Synfluid PAO-6 | 50 | 90 | 10 | 50 | 50 | 50 | 50 | 50 | 25 | 25 |
| PO-700 | 50 | 10 | 90 | 10 | 25 | 30 | 40 | | 75 | 50 |
| PO/BO-760 | | | | 40 | 25 | 20 | 10 | 50 | | 25 |
| appearance | 2-layers | turbid | clear | clear | clear | clear | 2-layers | clear | 2 layers | clear |
| | C. Ex % | C. Ex % | C. Ex % | Inv. Ex % | C. Ex % | C. Ex % | C. Ex % | C. Ex % | C. Ex % | C. Ex % |
| Synfluid PAO-6 | 50 | 90 | 10 | 50 | 50 | 50 | 50 | 50 | 25 | 25 |
| PO-1300 | 50 | 10 | 90 | 10 | 25 | 30 | 40 | | 75 | 50 |
| PO/BO-760 | | | | 40 | 25 | 20 | 10 | 50 | | 25 |
| appearance | 2 layers | 3 layers | clear | clear | 2 layers | 2 layers | 2 layers | clear | 2 layers | 2 layers |
| Synfluid PAO-6 | 50 | 90 | 10 | 50 | 50 | 50 | 50 | 50 | 25 | 25 |
| PO-2600 | 50 | 10 | 90 | 10 | 25 | 30 | 40 | | 75 | 50 |
| PO/BO-760 | | | | 40 | 25 | 20 | 10 | 50 | | 25 |
| appearance | 2 layers | clear | clear | 2 layers | 2 layers | 2 layers | clear | clear | 2 layers | 2 layers |

Summary of Table 7. When the PAO (Group IV oil) treat level is 50%, it is possible to solubilize 30% PO homo-polymer having molecular weight of 700 with PO/BO-760. When the molecular weight of the PO homo-polymer increases to 1300 g/mole (PO-1300) and 2600 g/mole (PO-2600), 10% can be solubilized.

TABLE 8

| Compositions of a Group IV PAO oil with PO/BO-1400 | | | | | | | | | | |
|---|---|---|---|---|---|---|---|---|---|---|
| | C. Ex % | C. Ex % | C. Ex % | Inv. Ex % | C. Ex % | C. Ex % | C. Ex % | C. Ex % | C. Ex % | Inv. Ex % |
| Synfluid PAO-6 | 50 | 90 | 10 | 50 | 50 | 50 | 50 | 50 | 25 | 25 |
| PO-700 | 50 | 10 | 90 | 10 | 25 | 30 | 40 | | 75 | 50 |
| PO/BO-1400 | | | | 40 | 25 | 20 | 10 | 50 | | 25 |
| appearance | 2-layers | turbid | clear | clear | 2 layers | 2 layers | 3 layers | clear | 2 layers | clear |
| | C. Ex % | C. Ex % | C. Ex % | Inv. Ex % | C. Ex % | C. Ex % | C. Ex % | C. Ex % | C. Ex % | C. Ex % |
| Synfluid PAO-6 | 50 | 90 | 10 | 50 | 50 | 50 | 50 | 50 | 25 | 25 |
| PO-1300 | 50 | 10 | 90 | 10 | 25 | 30 | 40 | | 75 | 50 |
| PO/BO-1400 | | | | 40 | 25 | 20 | 10 | 50 | | 25 |
| appearance | 2 layers | 3 layers | turbid | clear | 2 layers | 3 layers | 3 layers | clear | 2 layers | 3 layers |
| | C. Ex % | C. Ex % | C. Ex % | C. Ex % | C. Ex % | C. Ex % | C. Ex % | C. Ex % | C. Ex % | C. Ex % |
| Synfluid PAO-6 | 50 | 90 | 10 | 50 | 50 | 50 | 50 | 50 | 25 | 25 |
| PO-2600 | 50 | 10 | 90 | 10 | 25 | 30 | 40 | | 75 | 50 |
| PO/BO-1400 | | | | 40 | 25 | 20 | 10 | 50 | | 25 |
| appearance | 2 layers | clear | clear | 2 layers | 2 layers | 2 layers | 2 layers | clear | 2 layers | 2 layers |

Summary of Table 8. When the PAO treat level is 50%, it is possible to solubilize 10% PO homo-polymer (mol weight 700 and 1300 g/mole) with PO/BO-1400.

TABLE 9

Compositions of a Group IV PAO oil with PO/BO-2400

| | C.Ex % | C.Ex % | C.Ex % | C.Ex % | C.Ex % | C.Ex % | C.Ex % | C.Ex % | C.Ex % | C.Ex % |
|---|---|---|---|---|---|---|---|---|---|---|
| Synfluid PAO-6 | 50 | 90 | 10 | 50 | 50 | 50 | 50 | 50 | 25 | 25 |
| PO-700 | 50 | 10 | 90 | 10 | 25 | 30 | 40 | | 75 | 50 |
| PO/BO-2400 | | | | 40 | 25 | 20 | 10 | 50 | | 25 |
| appearance | 2-layers | turbid | clear | 2 layers | 2 layers | 2 layers | 2 layers | 2 layers | 2 layers | 2 layers |
| Synfluid PAO-6 | 50 | 90 | 10 | 50 | 50 | 50 | 50 | 50 | 25 | 25 |
| PO-1300 | 50 | 10 | 90 | 10 | 25 | 30 | 40 | | 75 | 50 |
| PO/BO-2400 | | | | 40 | 25 | 20 | 10 | 50 | | 25 |
| appearance | 2 layers | 3 layers | turbid | 2 layers | 2 layers | 3 layers | 2 layers | 2 layers | 2 layers | 3 layers |
| Synfluid PAO-6 | 50 | 90 | 10 | 50 | 50 | 50 | 50 | 50 | 25 | 25 |
| PO-2600 | 50 | 10 | 90 | 10 | 25 | 30 | 40 | | 75 | 50 |
| PO/BO-2400 | | | | 40 | 25 | 20 | 10 | 50 | | 25 |
| appearance | 2 layers | turbid | clear | 3 layers | 2 layers | 2 layers | 3 layers | 2 layers | 2 layers | 2 layers |

Summary of Table 9. PO homo-polymers were not readily soluble with PO/BO-2400 at levels of 10% and higher with the PAO-6 base oil.

TABLE 10

Compositions of a Group I Mineral oil with EO/PO-1300 and PO/BO-760

| | C. Ex % | C. Ex % | C. Ex % | C. Ex % | C. Ex % | C. Ex % |
|---|---|---|---|---|---|---|
| Total 150 SN | 50 | 90 | 50 | 50 | 50 | 50 |
| EO/PO-1300 | | 10 | 10 | 25 | 30 | 40 |
| PO/BO-760 | 50 | | 40 | 25 | 20 | 10 |
| appearance | clear | turbid | 2-phases | 3-phases | 3-phases | 3-phases |

Summary of Table 10. Table 10 shows that it is not possible to solubilize a classical EO/PO copolymer (EO/PO-1300) with PO/BO-760.

TABLE 11

Compositions of a Group I Mineral oil with PO-400 and PO/BO-760

| | C. Ex % | C. Ex % | Inv. Ex % | C. Ex % | C. Ex % | C. Ex % |
|---|---|---|---|---|---|---|
| Total 150 SN | 50 | 90 | 50 | 50 | 50 | 50 |
| PO-400 | | 10 | 10 | 25 | 30 | 40 |
| PO/BO-760 | 50 | | 40 | 25 | 20 | 10 |
| appearance | clear | turbid | clear | 2-phases | 3-phases | 3-phases |

Summary of Table 11. Table 11 shows it is possible to solubilize other types of PO homo-polymers with PO/BO-760. In this case PO-400 is an example of a diol initiated PO homo-polymer (often referred to as a polypropylene glycol). PO-400 is an example of a polymer with two terminal OH groups. The other PO homo-polymer examples are based on butanol initiated PO homo-polymers (one terminal OH group). In the example in Table 11, it is possible to couple 10% of a polypropylene glycol in a Group I mineral oil.

TABLE 12

Compositions of a Group IV PAO (high viscosity) with PO-700 and PO/BO-760

| | C.Ex | C.Ex | C.Ex % | C.Ex % | C.Ex % | C.Ex % |
|---|---|---|---|---|---|---|
| Spectrasyn PAO-40 | 50 | 90 | 50 | 50 | 50 | 50 |
| PO-700 | | 10 | 10 | 25 | 30 | 40 |
| PO/BO-760 | 50 | | 40 | 25 | 20 | 10 |
| appearance | clear | turbid | 2-phases | 2-phases | 2-phases | 3-phases |

Table 12 shows solubility data in a high viscosity PAO. These types of PAO are very difficult to formulate with and even more so than the lower viscosity PAO-6 described in Tables 7-9. It was not possible to couple a PO homo-polymer (PO-700) using PO/BO-760.

TABLE 13

Compositions of a Group IV PAO (high viscosity) with PO-1300 and PO/BO-760

| | C.Ex | C.Ex | C.Ex % | C.Ex % | C.Ex % | C.Ex % |
|---|---|---|---|---|---|---|
| Spectrasyn PAO-40 | 50 | 90 | 50 | 50 | 50 | 50 |
| PO-1300 | | 10 | 10 | 25 | 30 | 40 |
| PO/BO-760 | 50 | | 40 | 25 | 20 | 10 |
| appearance | clear | turbid | 2-phases | 2-phases | 2-phases | 2-phases |

Table 13 shows again it is not possible to couple a PO homo-polymer (PO-1300) using PO/BO-760.

TABLE 14

Compositions of a Group IV PAO (low viscosity) with PO/BO-760

| | C. Ex % | Inv Ex % | C. Ex % | In Ex % |
|---|---|---|---|---|
| Synfluid PAD 4 | 90 | 50 | 90 | 50 |
| PO/BO-760 | | 40 | | 40 |
| PO-700 | 10 | 10 | | |
| PO-1300 | | | 10 | 10 |
| appearance | clear | clear | turbid | clear |

Table 14 shows solubility data using a very low viscosity PAO. When PAO treat level is 50%, it is possible to solubilize 10% PO homo-polymer with PO/BO-760. This can be accomplished with PO-700 (mol weight 700 g/mole) and PO-1300 (mol weight 1300 g/mole).

TABLE 15

Compositions of a Group IV PAO with PO/BO-760

| | C. Ex % | Inv Ex % | C. Ex % | In Ex % |
|---|---|---|---|---|
| Spectrasyn 8 | 90 | 50 | 90 | 50 |
| PO/BO-760 | | 40 | | 40 |
| PO-700 | 10 | 10 | | |
| PO-1300 | | | 10 | 10 |
| appearance | turbid | clear | turbid | clear |

Table 15 shows solubility data using another low viscosity PAO. When the PAO treat level is 50%, it is possible to solubilize 10% PO homo-polymer with PO/BO-760. This can be accomplished with PO-700 (mol weight 700 g/mole) and PO-1300 (mol weight 1300 g/mole).

The practicality of the invention can be further illustrated in Table 16. This illustrates that the inclusion of a PO homo-polymer (formulation B) to a hydrocarbon oil (Total 150SN) can lead to a significant boost in viscosity index. In example A and B the total treat level of PAG is 50%.

TABLE 16

| | A % | B % |
|---|---|---|
| Total 150 SN | 50 | 50 |
| PO-1300 | | 40 |
| PO/BO-1400 | 50 | 10 |
| viscosity 40° C. [cSt] | 40.5 | 41.4 |
| viscosity 100° C. [cSt] | 7.3 | 7.7 |
| Viscosity index | 146 | 160 |

Tables 17-20 show coupling studies with BO homo-polymers.

TABLE 17

Compositions of a Group I Mineral oil (low viscosity) with Diol initiated butoxylates

| | C.Ex % | C.Ex % | Inv Ex. % | Inv Ex. % | Inv Ex. % | Inv Ex. % |
|---|---|---|---|---|---|---|
| Shell Catenex S 523 (HVI 60) | 90 | 50 | 50 | 50 | 50 | 50 |
| PO-700 | 10 | 50 | 25 | 25 | 10 | 10 |
| BO-2 | | | 25 | | 40 | |
| BO-1 | | | | 25 | | 40 |
| Appereance | turbid | turbid | clear | clear | clear | clear |

TABLE 18

Compositions of a Group I Mineral oil with alcohol initiated butoxylates

| | C.Ex % | C.Ex % | Inv Ex. % | Inv Ex. % | Inv Ex. % | Inv Ex. % |
|---|---|---|---|---|---|---|
| Shell Catenex S 523 (HVI 60) | 90 | 50 | 50 | 50 | 50 | 50 |
| PO-700 | 10 | 50 | 25 | 25 | 10 | 10 |
| BO-3 | | | 25 | | 40 | |
| BO-4 | | | | 25 | | 40 |
| Appearance | turbid | turbid | clear | clear | clear | clear |

Tables 17 and 18 demonstrate that diol initiated butoxylates and alcohol initiated butoxylates can couple a PO homo-polymer when the latter is a levels of 10 and 25% in a group I mineral oil.

TABLE 19

Compositions of a Group IV PAO with Diol initiated butoxylates

| | C.Ex % | C.Ex % | C.Ex % | C.Ex % | Inv Ex. % | Inv Ex. % |
|---|---|---|---|---|---|---|
| Synfluid PAO-6 | 90 | 50 | 50 | 50 | 50 | 50 |
| PO-700 | 10 | 50 | 25 | 25 | 10 | 10 |
| BO-2 | | | 25 | | 40 | |
| BO-1 | | | | 25 | | 40 |
| Appearance | turbid | turbid | turbid | turbid | clear | clear |

TABLE 20

Compositions of a Group IV PAO with alcohol initiated butoxylates

| | C.Ex % | C.Ex % | Inv Ex % | Inv Ex. % | Inv Ex. % | Inv Ex. % |
|---|---|---|---|---|---|---|
| Synfluid PAO-6 | 90 | 50 | 50 | 50 | 50 | 50 |
| PO-700 | 10 | 50 | 25 | 25 | 10 | 10 |
| BO-3 | | | 25 | | 40 | |
| BO-4 | | | | 25 | | 40 |
| Appearance | turbid | turbid | clear | clear | clear | clear |

Tables 19 demonstrates that diol initiated butoxylates can couple a PO homo-polymer when the latter is a levels of 10% in a Group IV PAO base oil.

Tables 20 demonstrates that alcohol initiated butoxylates can couple a PO homo-polymer when the latter is a levels of 10 and 25% in a Group IV PAO base oil.

The invention claimed is:

1. A lubricant composition comprising:

a hydrocarbon base oil;

a polyoxypropylene polymer prepared by polymerizing propylene oxide with an initiator containing a labile hydrogen; and a polyoxyalkylene polymer prepared by polymerizing an alkylene oxide feed with an initiator containing a labile hydrogen, the alkylene oxide feed comprising from 100 to 25 percent butylene oxide and from 0 to 75 percent propylene oxide, each by weight based on the total weight of the alkylene oxide feed, provided that when the alkylene oxide feed contains greater than 50 weight percent propylene oxide, the initiator is a C8-C20 alkyl alcohol, the hydrocarbon base oil, polyoxypropylene polymer and polyoxyalkylene polymer being soluble with one another, with the proviso that the polyoxypropylene polymer is from 10% to 80% of the composition; and with the further proviso that if the polyoxyalkylene polymer were fully replaced by the polyoxypropylene polymer, then the hydrocarbon base oil and polyoxypropylene polymer would not be soluble with one another.

2. The lubricant composition of claim 1 wherein the initiator for the polyoxypropylene polymer and the polyoxyalkylene polymer is independently a diol or a monol.

3. The lubricant composition of claim 1 wherein the initiator for the polyoxypropylene polymer and the polyoxyalkylene polymer is independently a $C_4$-$C_{22}$ alkyl alcohol.

4. The lubricant composition of claim 1 wherein the initiator for the polyoxypropylene polymer and the polyoxyalkylene polymer is independently butanol, pentanol, hexanol, neopentanol, isobutanol, heptanol, octanol, 2-ethylhexanol, nonanol, decanol, propylene glycol n-butyl ether, 1,2-propyleneglycol, dipropylene glycol n-butyl ether, or dodecyl alcohol.

5. The lubricant composition of claim 1 comprising up to 50 percent of the hydrocarbon base oil, up to 80 percent of the polyoxypropylene polymer, and up to 50 percent of the polyoxyalkylene polymer, each by weight based on the total weight of the hydrocarbon base oil, the polyoxypropylene polymer, and the polyoxyalkylene polymer.

6. The lubricant composition of claim 1 comprising, based on the total weight of the hydrocarbon base oil, the polyoxypropylene polymer, and the polyoxyalkylene polymer, up to 50 weight percent of a Group I hydrocarbon base oil and up to 40 weight percent of the polyoxypropylene polymer and wherein the polyoxypropylene polymer has a molecular weight of up to 1300 g/mole and the polyoxyalkylene polymer is a PO/BO copolymer with a molecular weight up to 2400 g/mole.

7. The lubricant composition of claim 1 comprising, based on the total weight of the hydrocarbon base oil, the polyoxypropylene polymer, and the polyoxyalkylene polymer, up to 50 weight percent of a Group I hydrocarbon base oil and up to 25 weight percent of the polyoxypropylene polymer, and wherein the polyoxypropylene polymer has a molecular weight of up to 2600 g/mole and the polyoxyalkylene polymer is a PO/BO copolymer with a molecular weight up to 1400 g/mole.

8. The lubricant composition of claim 1 comprising, based on the total weight of the hydrocarbon base oil, the polyoxypropylene polymer, and the polyoxyalkylene polymer, up to 50 weight percent of a Group I hydrocarbon base oil and up to 10 weight percent of the polyoxypropylene polymer, and wherein the polyoxypropylene polymer has a molecular weight of up to 2600 g/mole and the polyoxyalkylene polymer is a PO/BO copolymer with a molecular weight up to 2400 g/mole.

9. The lubricant composition of claim 1 comprising, based on the total weight of the hydrocarbon base oil, the polyoxypropylene polymer, and the polyoxyalkylene polymer, up to 50 weight percent of a Group III hydrocarbon base oil and up to 30 weight percent of the polyoxypropylene polymer, and wherein the polyoxypropylene polymer has a molecular weight of up to 700 g/mole and the polyoxyalkylene polymer is a PO/BO copolymer with a molecular weight up to 760 g/mole.

10. The lubricant composition of claim 1 comprising, based on the total weight of the hydrocarbon base oil, the polyoxypropylene polymer, and the polyoxyalkylene polymer, up to 50 weight percent of a Group III hydrocarbon base oil and up to 10 weight percent of the polyoxypropylene polymer, and wherein the polyoxypropylene polymer has a molecular weight of up to 1300 g/mole and the polyoxyalkylene polymer is a PO/BO copolymer with a molecular weight up to 1400 g/mole.

11. The lubricant composition of claim 1 comprising, based on the total weight of the hydrocarbon base oil, the polyoxypropylene polymer, and the polyoxyalkylene polymer, up to 50 weight percent of a Group IV hydrocarbon base oil having a kinematic viscosity at 100° C. of 8 $mm^2/s$ or less and up to 30 weight percent of the polyoxypropylene polymer, and wherein the polyoxypropylene polymer has a molecular weight of up to 700 g/mole and the polyoxyalkylene polymer is a PO/BO copolymer with a molecular weight up to 760 g/mole.

12. The lubricant composition of claim 1 comprising, based on the total weight of the hydrocarbon base oil, the polyoxypropylene polymer, and the polyoxyalkylene polymer, up to 50 weight percent of a Group I, Group III, or Group IV hydrocarbon base oil and up to 30 weight percent of the polyoxypropylene polymer, and wherein the polyoxypropylene polymer has a molecular weight of up to 700 g/mole and the polyoxyalkylene polymer is a PO/BO copolymer with a molecular weight up to 760 g/mole.

13. The lubricant composition of claim 1 comprising, based on the total weight of the hydrocarbon base oil, the polyoxypropylene polymer, and the polyoxyalkylene polymer, up to 50 weight percent of a Group I or Group IV hydrocarbon base oil and up to 25 weight percent of the polyoxypropylene polymer, wherein the polyoxyalkylene polymer is a diol initiated BO homopolymer or an alkyl alcohol initiated BO homopolymer.

14. A method of lubricating a mechanical device, the method comprising using the lubricant composition of claim 1 to lubricate the mechanical device.

* * * * *